US006823701B1

(12) United States Patent
Gogel

(10) Patent No.: US 6,823,701 B1
(45) Date of Patent: Nov. 30, 2004

(54) DOOR LATCHING DEVICE

(76) Inventor: Roy E. Gogel, 218 E. Cranberry La., Greenville, SC (US) 29615

( * ) Notice: Subject to any disclaimer, the term of this patent is extended or adjusted under 35 U.S.C. 154(b) by 0 days.

(21) Appl. No.: 10/651,686

(22) Filed: Aug. 29, 2003

(51) Int. Cl.[7] ..... E05B 13/00

(52) U.S. Cl. ..... 70/32; 70/56; 70/129; 70/212; 292/148; 292/205; 292/218; 292/DIG. 32

(58) Field of Search ..... 70/54–56, 129, 70/32–34, DIG. 43, DIG. 56, 202, 203, 211, 212; 292/148, 205, 218, DIG. 32

(56) References Cited

U.S. PATENT DOCUMENTS

| | | | | | |
|---|---|---|---|---|---|
| 3,976,318 | A | | 8/1976 | Krus | 292/346 |
| 4,095,828 | A | * | 6/1978 | East | 292/148 |
| 4,688,409 | A | * | 8/1987 | Oliver et al. | 70/417 |
| 4,883,294 | A | * | 11/1989 | Goodspeed | 292/148 |
| 5,168,258 | A | | 12/1992 | Radke | 340/542 |
| 5,946,952 | A | * | 9/1999 | Mintchenko | 70/2 |
| 6,009,731 | A | * | 1/2000 | Emmons et al. | 70/56 |
| 6,058,745 | A | | 5/2000 | Sanchez | 70/56 |
| 6,233,984 | B1 | | 5/2001 | Blehi, III | 70/34 |
| 6,367,292 | B1 | | 4/2002 | Bunger | 70/56 |
| 6,442,982 | B1 | * | 9/2002 | Larsen et al. | 70/3 |
| 6,463,769 | B1 | | 10/2002 | Garner | 70/56 |
| 6,494,064 | B1 | | 12/2002 | Pena | 70/56 |
| 6,668,601 | B1 | * | 12/2003 | Reddick | 70/56 |

* cited by examiner

*Primary Examiner*—Lloyd A. Gail
(74) *Attorney, Agent, or Firm*—Charles L. Schwab; Nexsen Pruet, LLC

(57) ABSTRACT

A door latching device is disclosed that is mountable to conventional doors, including cargo container doors and garage doors, for preventing opening thereof. A conventional keyed lock, such as a padlock or puck-shaped protected shackle lock, couples with the latching device to lock the latching device in a latched position with a door. The latching device includes a rigid housing having an attachment bolt affixed thereto for securing the latching device to the door, a slidable locking pin having an opening for receiving a locking pin ingress/egress. In a locked position, the locking pin protrudes from the housing, and the lock is coupled with the locking pin to prevent movement of the same. In an unlocked position, the lock is uncoupled from the locking pin to permit sliding of the locking pin. The housing provides limited access to the lock once the lock is coupled with the locking pin.

4 Claims, 5 Drawing Sheets

DOOR LATCHING DEVICE

FIELD OF THE INVENTION

This invention relates generally to latching devices, and more particularly to a latching mechanism for preventing opening of conventional doors.

BACKGROUND OF THE INVENTION

Securing cargo container doors, such as tractor trailer container doors and storage container doors, and preventing unauthorized opening of container doors are important to protecting the contents of the container. The use of locks alone to prevent unauthorized opening of container doors is inadequate because of the physical vulnerabilities of the locks. Locks are commonly broken or destroyed by means such as applying a hammer to the lock body or by applying a lock cutter to a locking bar or shackle of the lock. Once the lock is broken, access to the contents of the container is inevitable. A number of devices have been proposed in the past to prevent destruction of the locks or minimize access to the lock body.

U.S. Pat. No. 3,976,318 describes a protector for a lock mounted on a door hinged to a doorframe. The protector includes a lock cover and a plate that prevents access to the lock. The lock cover member includes an opening for access to a keyhole of the lock and is bolted to the door and over the lock. The plate includes a slot and is attached to a doorjamb such that when the door is closed, the lock cover fits snugly in the slot thereby preventing access to one side of the lock cover.

U.S. Pat. No. 5,168,258 describes a padlock protecting device to secure a conventional latch assembly found on a cargo door of a truck. The latch assembly includes a locking lever, lever retaining mechanism attached to the cargo door, and lock coupled to the lever retaining mechanism. The protecting device includes a pivoting cover mounted to the cargo door for enclosing the lock and lever retaining mechanism, a detector switch that engages the cover when the cover is closed and detects displacement of the cover, and an alarm connected to the detector switch that emits an alarm signal during unauthorized displacement of the cover.

U.S. Pat. No. 6,058,745 describes a padlock cover assembly for use with shackle type padlocks. The padlock cover assembly includes a padlock mounting bracket that is attached to one door and a cover secured to another door and advanceable to cover a padlock secured to the mounting bracket. The mounting bracket includes two tabs, and the cover has a latch finger that is positioned inside the cover and a tab. When the cover is placed over the padlock and the padlock is locked, the latch finger catches the apex of the shackle and one of the tabs and the tab of the cover catches the second tab of the mounting bracket. An access hole is provided at the bottom of the cover to access a keyhole of the padlock.

U.S. Pat. No. 6,233,984 describes a semitrailer cargo door locking system for use with an upper hasp and a lower hasp to secure a door handle. The system includes a shackleless lock that receives the upper and lower hasps when the hasps are aligned. A locking bolt within the shackleless lock engages the aligned hasps by a key-activated tumbler to lock the hasps in the aligned position.

U.S. Pat. No. 6,367,292 describes a padlock protector for use with disk type padlocks having circular shackles to lock two moveable objects of a cargo container in a fixed relationship. The padlock protector includes a housing that is mounted to one of the objects, a moveable bar mounted on the interior of the housing to engage a sleeve mounted on the other object, a lower collar for enclosing the bar and having a padlock retainer at one end with a shackle receiving opening, and an upper collar for enclosing the bar having a keyhole protector. A predetermined hole is formed in the length of the bar. The keyhole protector provides access to a key to a keyhole slot of the padlock when the padlock is shackled through the hole of the bar.

U.S. Pat. No. 6,463,769 describes a padlock lock box for protecting the padlock from bolt cutters. The lock box includes a housing that is securable to a door and has an aperture in the back for receiving a fixed hasp plate that is secured to a second door or to a doorframe. The hasp plate has an opening for receiving a shackle of the padlock. The lock box has an open bottom to receive the padlock, and the front of the lock box includes an aperture for key access to the padlock.

U.S. Pat. No. 6,494,064 describes an enclosed lock device for use with a padlock having a shackle. The lock device includes a latch box, a strike box, and a slide assembly. The latch box has a guide bar with a channel for passing the top of the shackle therethrough, a pivoting link having a hole for receiving the shackle, and a travel limiter above the guide bar. The slide assembly includes a slidable latch located between the guide bar and the travel limiter and the padlock that is attached to the latch. The strike box includes a strike plate with a slot for receiving the latch. The bottom of the latch box has an opening for a key to access the padlock.

Trailer cargo doors commonly include rotatable stanchions that are permanently held to the exterior of the cargo doors by brackets. The stanchions are rotated to a locking position and typically secured by a lock, such as a padlock or shackle lock described in the locking system of U.S. Pat. No. 6,233,984. However, none of the aforementioned lock protecting devices may be coupled directly with stanchions found on conventional trailer cargo doors to secure the stanchions in a locked position, or prohibit movement of the stanchions, and prevent unauthorized opening of the doors. Additionally, none of the aforementioned lock protecting devices may be coupled directly with the stanchions and simultaneously protect the lock device.

SUMMARY OF THE INVENTION

An object of this invention is to provide a lock protecting device that secures a door in a locked position.

A more particular object of this invention is to provide a lock protecting device that may be coupled with conventional cargo container stanchions to secure the stanchions in a locked position.

Another object of this invention is to provide a lockable door latching system that secures a door to a door frame or an immoveable object adjacent to the door and prevents unauthorized tampering of the lock.

Yet another object of this invention is to provide a door latching device for use with a lock that protects the lock from unauthorized tampering.

These and other objects of the invention are accomplished by providing a latching device for securing a door in a closed position. The latching device includes a rigid housing having an attachment bolt affixed thereto for securing the latching device to a door, a slidable locking pin having an opening for receiving a locking bar or shackle of a lock, and a guide coupled with the locking pin. The rigid housing includes an opening for receiving the lock, an opening providing limited access to a keyhole of the lock (which may or may not be combined with the lock), and a locking pin ingress/egress. In a latched position, the locking pin protrudes from the housing, and the lock is coupled with the locking pin to prevent movement of the same. In an unlatched position, the lock is uncoupled from the locking pin to permit displacement of the locking pin. The housing provides limited access to the lock once the lock is coupled with the locking pin. In applications of securing cargo container doors having stanchions, the latching device is mounted substantially adjacent to a desired stanchion that includes an aperture for receiving the locking pin. In alternative applications for securing a door that operatively couples with an immoveable object, such as a doorframe or fixed door, the latching device is mounted substantially adjacent to the object that includes an aperture for receiving the locking pin. The locking pin and the aperture are preferably aligned when the door is in the closed position to permit insertion of the locking pin into the aperture.

These and other objects of the invention are also accomplished by providing a door latching system having a lockable latch, a means for receiving the latch to secure a door in a closed position against an immovable object, and a lock engageable with the latch and having a key receiving portion, such as a keyhole. The lockable latch includes a rigid housing providing restricted access to the lock when the lock is positioned therein, a slidable locking pin coupled with the housing, and a means for affixing the lockable latch to the door, such as an attachment bolt and nut. The housing has a first opening for receiving the lock, a second opening for accessing the key receiving portion of the lock, and a locking pin ingress/egress. The locking pin has an aperture for receiving a locking bar or shackle of the lock. Depending on the type of door desired to be secured, an aperture is preferably formed in the immoveable object to receive the locking pin when the door is in the closed position.

DETAILED DESCRIPTION OF THE INVENTION

The present invention is a latching device for securing a door in a closed position. Additionally, the present invention is a door latching system for securing a door in the closed position using a conventional lock. The latching device is ideally suited to directly couple with and secure cargo stanchions, such as found on storage container and tractor trailer doors, in a position that prevents opening of the cargo container door. Additionally, the latching device may be used to secure a door in a closed position relative to a corresponding immoveable object, such as a doorframe or fixed door. For example, the latching device may be affixed to a conventional rolling door, such as used in a garage, mini-storage, and/or tractor trailer, where the rolling door is latched and locked relative to a door frame such that the rolling door is secured in a closed position. Keyed locks are preferably used with the latching device.

As used herein, the term "locking bar" is defined to mean a rod, bar, shaft, and/or shackle found on conventional locks including but not limited to padlocks and protected-shackle type locks. While a protected-shackle type lock, or shackleless type lock (e.g., puck-shape type lock), is shown and described for use with the locking device, the latching device is not intended to be limited to coupling with shackleless type locks and may be used with conventional shackle locks having key access, including but not limited to padlocks. Further, while the latching device is described with respect to securing a door in the closed position, the latching device may be used to secure the door in any desired position depending on the relationship of the door with respect to the corresponding immoveable object, such as a doorframe. Depending on a mounting location of the latching device and a location of a locking pin receiving aperture, described in greater detail hereinafter, the door is secured in varying degrees of open or closed positions. For example, depending on the mounting location of the latching device at varying heights of a conventional rolling garage door and the location of the receiving aperture at varying heights of a corresponding doorframe, the garage door is lifted to allow a partial opening into the garage and secured in such position by latching and locking the latching device.

Figure 1:
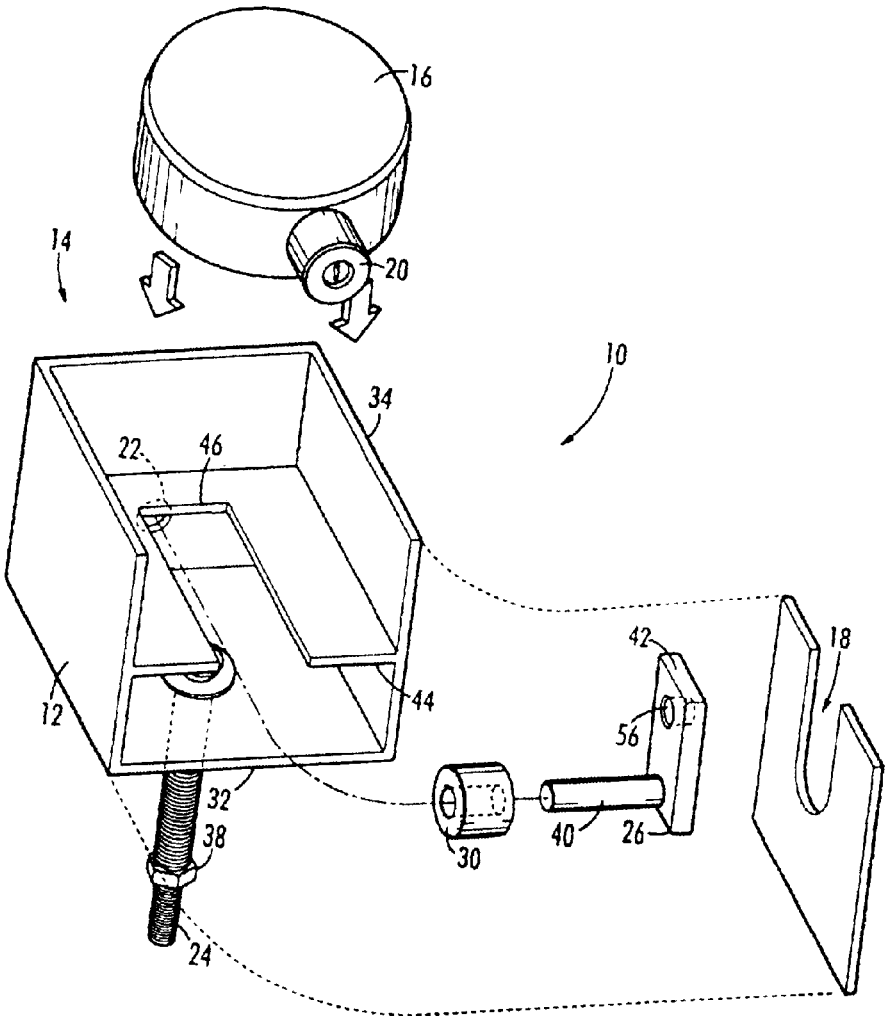
FIG. 1 is a partially exploded view of a latching device in accordance with the present invention.

FIG. 1 is a partially exploded view of a latching device, shown generally at 10, in accordance with the present invention. The latching device 10 includes a rigid housing 12, an attachment bolt 24 affixed to the housing 12, a slidable locking pin 26 operatively engageable with a locking bar 28 (FIGS. 3 and 4) of a lock 16, and a pin guide 30 coupled with the locking pin 26. In one embodiment of the present invention, a shackleless lock 16 is used, and as best shown in FIG. 1, the housing 12 restricts access to the lock 16 by surrounding a perimeter of the lock 16 to minimize tampering of the lock 16. In an alternative embodiment using a shackled lock, the slidable locking pin is operatively engageable with a shackle of such lock.

The rigid housing 12 has a bottom or back wall 32 and a side wall or side wall structure 34 connected to the back wall 32 and extending outward therefrom to form a front opening chamber for containing the puck shaped lock 16. The side wall structure 34 is preferably connected to the back wall 32 at a perimeter of the back wall 32. The side wall structure 34 forms a top opening, shown generally at 14, for receiving the lock 16 therethrough. The housing 12 includes a first opening, shown generally at 18, for accessing a key receiving portion 20 of the lock 16. The housing 12 has a second or locking pin ingress/egress opening 22. The first opening 18 is positioned on the housing 12 depending on the location of the key receiving portion 20 on the lock 16 and is preferably sized corresponding to the key receiving portion 20 of the lock 16 to restrict access to the lock 16. In this embodiment, the key receiving portion 20 of the lock 16 is located at the side of the lock 16, and extends through the first opening 18 (FIG. 3), which is positioned at the side of the housing 12, when the lock 16 is unlocked. The locking pin opening 22 is formed through the side wall structure 34 of the housing 12 opposite the part thereof in which the first opening 18 is formed and below a partition wall or tab guide 44 which is rigidly secured to the side wall structure 34 in spaced parallel relation to the back wall 32. The partition wall 44 divides the chamber of the housing 12 into an outer compartment in which the lock 16 is disposed and an inner compartment in which the locking pin opening 22 is formed. A pin guide 30 in the form of a cylindrical bushing with a cylindrical opening is secured to the side wall structure 34 in axial alignment with the locking pin opening 22, which is also cylindrical.

Figure 2:
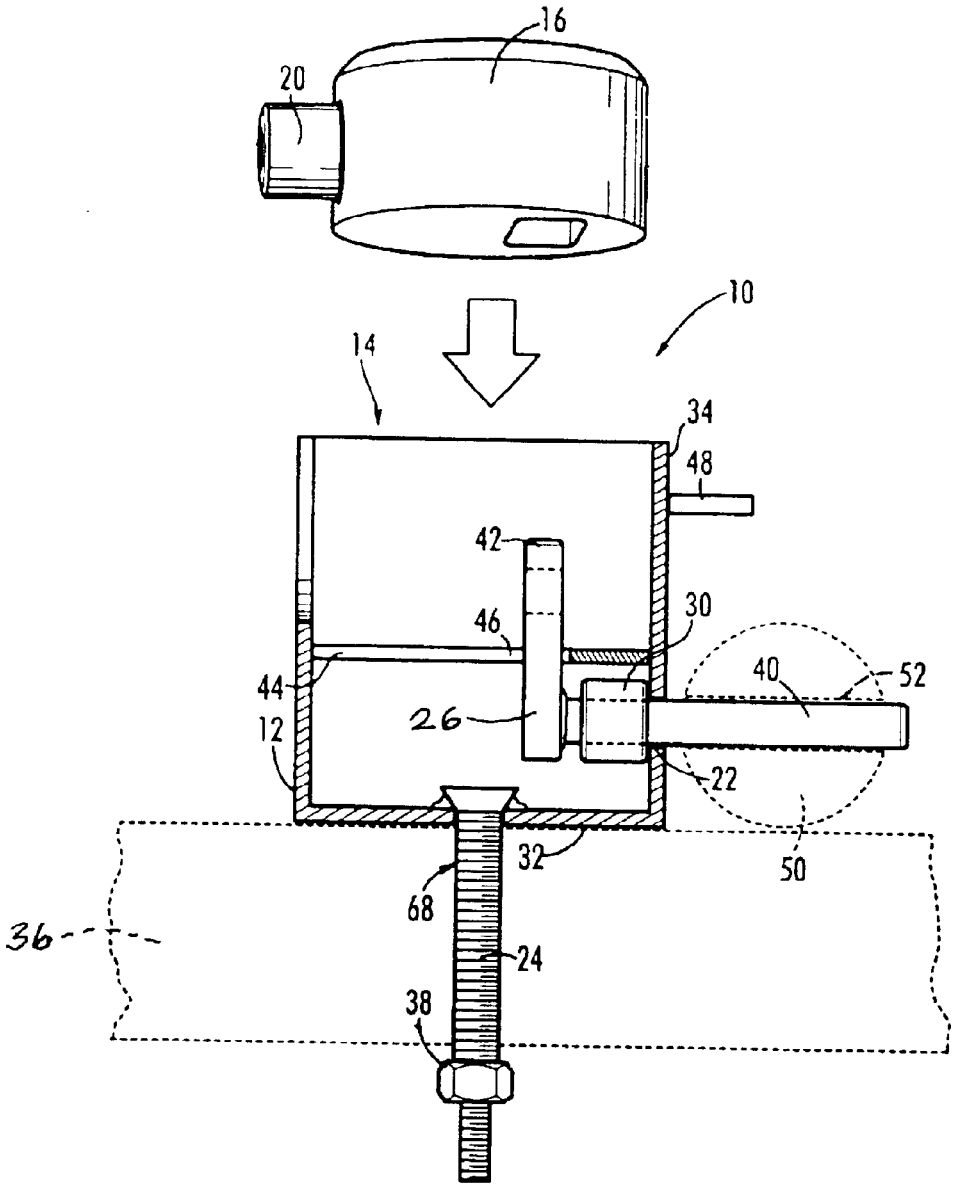
FIG. 2 is a sectional view of the latching device mounted to a container door, shown in broken line.

FIG. 2 is a sectional view of the latching device 10 mounted to a container door 36, shown in broken line, having a stanchion 50. FIG. 2 illustrates in a simple manner the desired mounting location of the latching device 10 with respect to the stanchion 50 which is not shown in proportional size relation to the latching device 10. For example, in an application of the present invention, the latching device more closely approximates a diameter of the stanchion, and a height of the latching device may be greater or lesser than the diameter of the stanchion. As best shown in FIG. 2, the attachment bolt 24 is affixed to the back plate 32 of the housing 12 for attachment to the door 36 such that the back plate 32 is positioned substantially adjacent the door 36. In one embodiment, the attachment bolt 24 is inserted through an opening, shown generally at 68, formed in the door 36 and a nut 38 is threaded onto the attachment bolt 24 to affix the housing 12 to the door 36. Conventional specialized adhesives or sealants may be used on the bolt 24 and nut 38 to prevent movement of the same. Alternatively, the housing 12 may be affixed to the door 36 using a variety of known techniques including, by way of example and not limitation, welding the back plate 32 to the door 36. Furthermore, the location of the housing is not critical to the present invention as long as the housing is attached to either the door or the immoveable object that is operatively coupled with the door and the locking pin receiving aperture is conversely located on either the immoveable object or the door, respectively.

The pin guide 30 is mounted to the interior of the housing 12 and adjacent to the locking pin ingress/egress 22 to guide the locking pin 26 into and out of the ingress/egress 22. The locking pin 26 has a cylindrical pin portion 40 and a tab 42 connected to the cylindrical pin portion 40 such that the tab 42 extends radially away from the cylindrical pin portion 40. The tab 42 has an opening 56 for receiving the locking bar 28 of the lock 16 therethrough. When the latching device 10 is unlocked, the locking pin 26 is displaceable with respect to the pin guide 30 in a sliding motion. In this embodiment, the locking pin receiving aperture 52 is formed in the stanchion 50. In a latched position, the locking pin 26 extends out through the pin guide 30 and the ingress/egress 22 and into the locking pin receiving aperture 52.

As best shown in FIG. 1, a tab guide 44 is positioned in the interior of the housing 12 and includes a channel 46 that receives the tab 42 of the locking pin 26 when the locking pin 26 is inserted through the pin guide 30. The tab guide 44 and the pin guide 30 together assist in guiding the movement of the locking pin 26 inside the housing 12 and through the ingress/egress 22.

In one embodiment of the present invention, a rigid cap 48 (FIGS. 2, 3 and 4) or shelf is optionally attached to the exterior of the housing 12 to prevent access to the locking pin 26. In this embodiment, the cap 48 is attached to the side wall 34 of the housing substantially adjacent to the locking pin ingress/egress 22 and away from the back plate 32 of the housing 12. When the latching device 10 is mounted adjacent to the stanchion 50 on the door 36, the locking pin 26 is between the door 36 and the cap 48. The dimension of the cap 48 may vary depending on the size of the stanchion as well as the latching device and preferably provides sufficient coverage to restrict access to the locking pin 26 when the latching device is mounted adjacent to the stanchion 50. The rigid cap 48 is ideally suited to prevent sawing of the locking pin 26.

In another embodiment, a tab retainer, not shown, may optionally be included to further prevent displacement of the locking pin 26. In this embodiment, the tab retainer is pivotally attached to the interior of the housing 12 and adjacent to the tab guide 44. The tab retainer includes a slot for receiving the tab 42 of the locking pin 26 when the latching device 10 is in the latched position and prevents movement of the locking pin 26 when the locking pin is received through the slot of the tab retainer. To permit movement of the locking pin 26, the tab retainer is pivoted away from the interior of the housing 12 such that the tab 42 exits the slot of the tab retainer.

Figure 3:
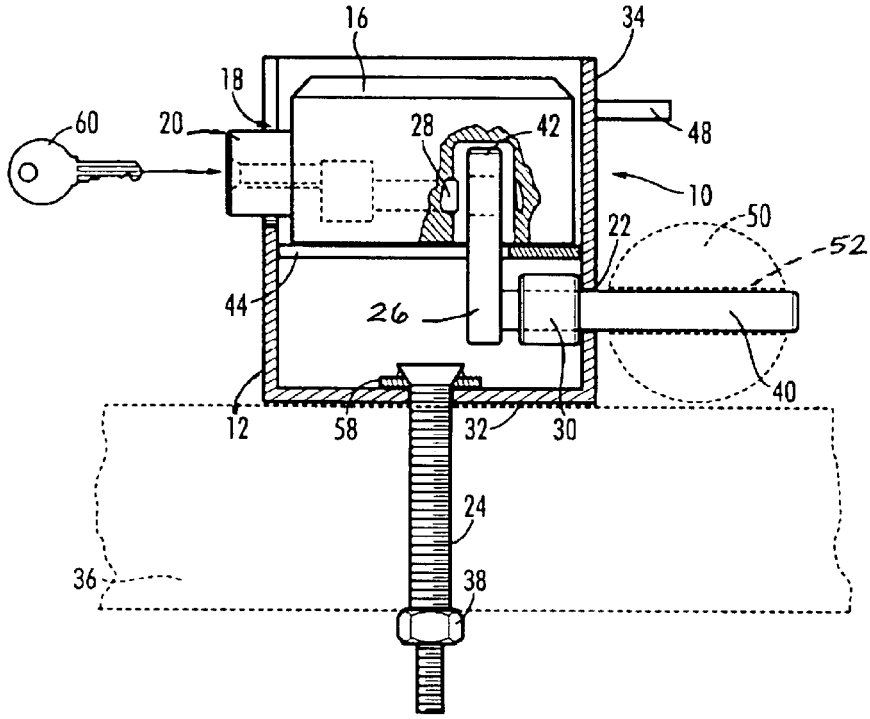
FIG. 3 is a partial sectional view of a lock coupled with the latching device shown in FIG. 2 illustrating a latched and unlocked position.

FIG. 3 is a partial sectional view of the lock 16 coupled with the latching device 10 that is attached to the door 36 illustrating a latched and unlocked position. In the latched position, the locking pin 26 is retained by the locking pin receiving aperture 52. After the lock 16 is positioned within the interior of the housing 12, the locking bar 28 is inserted through the opening 56 of the tab 42 to engage the lock. As previously mentioned hereinabove, the second opening 19 of the housing 12 permits a key 60 to access the key receiving portion 20 of the lock 16 to engage the lock 16 and lock the latching device 10 in a locked position or disengage the lock 16. Washers may optionally be used to assist in affixing the attachment bolt 24 to the housing 12. For example, a locking washer 58 is inserted between a head of the attachment bolt 24 and the back plate 32 when the attachment bolt 24 is affixed to the back plate 32.

As best shown in FIG. 3, the extent the side wall 34 extends away from the back plate 32 and the position of the tab guide 44, and the tab retainer when using the same, within the housing 12 preferably allows the lock 16 to rest against an outer surface of the tab guide 44 such that the side wall 34 extends a distance away from the back plate to sufficiently block access to all sides of the lock 16 with the exception of the key receiving portion 20.

In one embodiment, the back plate 32 is slightly raised with respect to the door 36 when the latching device 10 is mounted to the door 36. For example, when the latching device 10 is mounted to the door 36, the back plate 32 does not fit flush with the door 36 along the entire surface of the back plate 32 but the perimeter of the back plate 32 and/or the side wall 34 fits flush with the door 36. In this embodiment, a "bite" effect is created that counters any attempt to lift a side of the latching device 10 away from the door 36. When a side of the latching device 10 is lifted away from the door 36, an opposing side of the latching device 10 is pressed into the door 36 thereby countering such lift.

Figure 4:
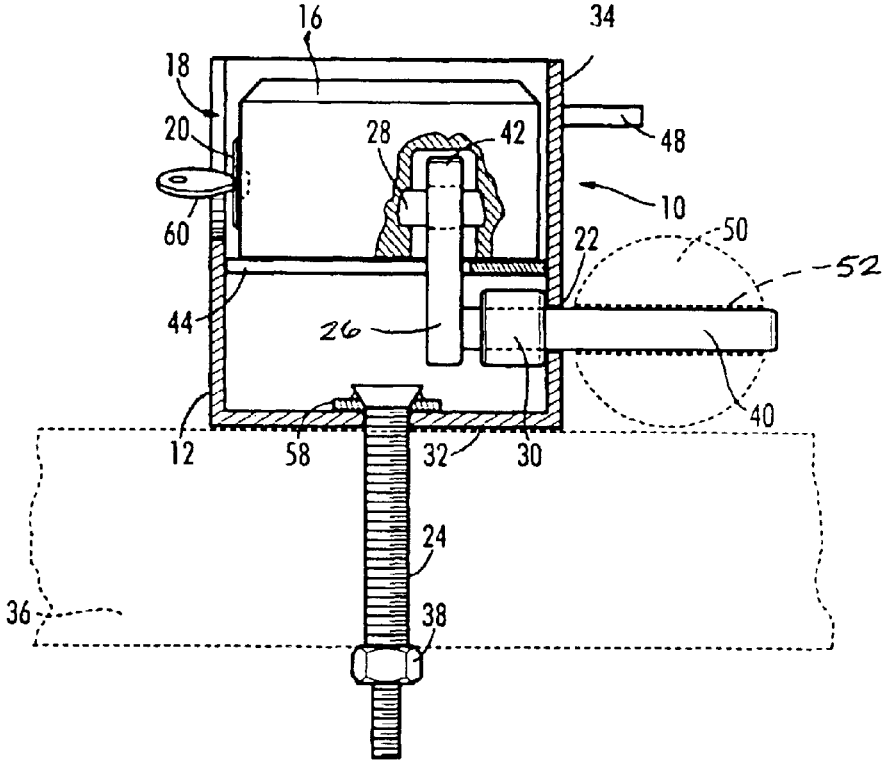
FIG. 4 is a partial sectional view of a lock coupled with the latching device shown in FIG. 2 illustrating a locked position.

FIG. 4 is a partial sectional view of the lock 16 coupled with the latching device 10 shown in FIG. 3 illustrating the locked position. In the locked position, the locking bar 28 is inserted through the opening 56 of the tab 42, and the key 60 engages the lock 16 so that the locking pin 26 cannot exit the locking pin receiving aperture 52. As best shown in FIGS. 2, 3, and 4, the housing 12 surrounds the perimeter of the lock 16 such that movement of the lock is minimized when the lock 16 is engaged. In the locked position, the lock 16 prevents movement of the locking pin 26 so that the aperture 52 retains the locking pin thereby securing the door 36 in the closed position.

Figure 5:
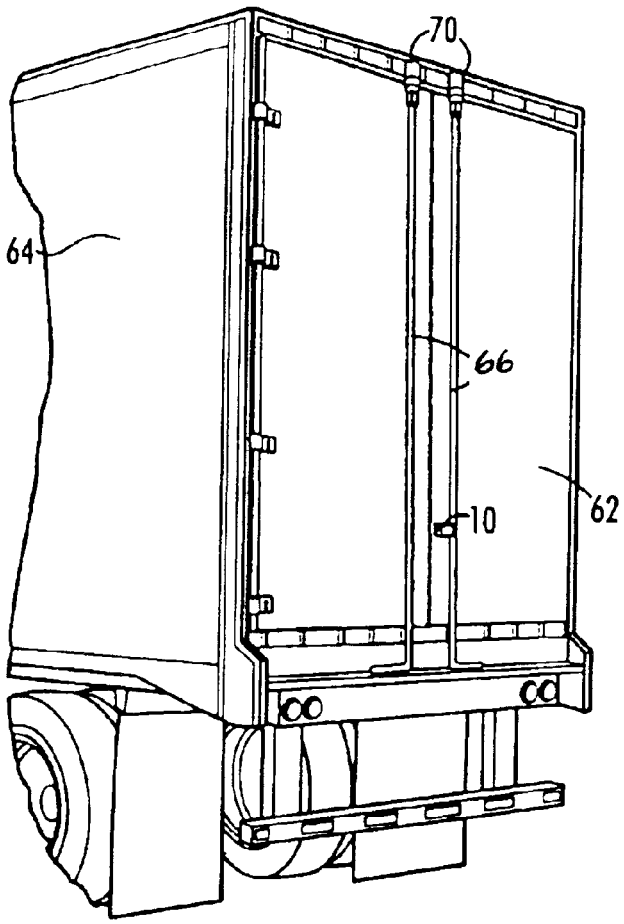
FIG. 5 is a perspective view of the latching device mounted to a container door of a tractor trailer in accordance with the present invention.

FIG. 5 is a perspective view of the latching device 10 mounted to a container door 62 of a tractor-trailer cargo container 64 in accordance with the present invention. The container door 62 has stanchions 66 that prevent movement of the door 62 using brackets 70. The stanchion has a foot connected to an end of the stanchion that catches a top or a bottom of the cargo container 64. The stanchions 66 typically operate by rotating the stanchion along an axis of the same to uncouple the stanchion from the bracket 70. Once the stanchion is uncoupled from the bracket, the stanchion is withdrawn from the bracket and the door to which the stanchion is attached may be opened.

As best shown in FIG. 5, the latching device 10 is mounted substantially adjacent to one of the stanchions 66 for direct coupling of the latching device 10 with the stanchion 66. The locking pin receiving aperture is preferably formed through the stanchion 66, and the latching device is mounted substantially adjacent to the locking pin receiving aperture. After the locking pin is inserted into and through the locking pin receiving aperture, rotation of the stanchion 66 is prevented thus preventing opening of the door 62. Coupling a lock, and locking the same, with the latching device 10 locks the locking pin in this position and thus locks the stanchion 66 in the closed position. Depending on the direction of rotation of the stanchion 66 to open the door 62, the latching device is most preferably mounted to a side of the stanchion such that rotation of the stanchion 66 to open the door 62 directs the locking pin and the latching device against the door 62.

As previously mentioned, a rigid cap or shelf may optionally be attached to the exterior of the housing to prevent access to the locking pin 26. In one embodiment, the cap is attached to the side wall of the housing substantially adjacent to the locking pin ingress/egress and away from the back plate of the housing. When the latching device 10 is mounted adjacent to the stanchion 66 on the door 62, the locking pin 26 is between the door and the cap. The rigid cap is ideally suited to prevent sawing of the locking pin 26.

Alternative Embodiment

Although the present invention is shown and described with respect to a shackleless lock, a shackled lock such as a conventional padlock with a shackle may also be used with the latching device. In this embodiment, the latching device remains substantially the same with modifications to the housing and protection of the locking pin. The latching device has a rigid housing, a slidable locking pin operatively engageable with the shackle, a pin guide coupled with the locking pin, and a stopper that prevents displacement of the locking pin. The housing includes a back plate, side walls connected to the back plate and extending outward therefrom, and a front plate opposing the back plate and connected to the side walls. The back plate, side walls, and front plate form a cavity for containing the lock and surrounding the shackle of the lock. The latching device has a first opening that is a bottom opening for coupling a shackled lock with the latching device that also provides access to key receiving portion of the lock. The locking pin ingress/egress is formed through one of the side walls of the housing.

The pin guide is mounted to the interior of the housing and adjacent to the locking pin ingress/egress to guide the locking pin into and out of the ingress/egress. The locking pin includes a pin portion connected to a tab extending radially away from the pin portion. The tab includes an opening for receiving the shackle of the lock. In this embodiment, the locking pin also pivots about an axis of the locking pin ingress/egress when the locking pin is received by the locking ingress/egress. The stopper is mounted to the interior of the housing and preferably mounted adjacent to the pin guide. The stopper includes a tab engaging portion that contacts the tab of the locking pin after the locking pin is inserted into the locking pin receiving aperture such that the tab engaging portion prevents displacement of the locking pin out of the receiving aperture.

The tab engaging portion of the stopper includes a slot for receiving the shackle of the lock so that the locking pin may be secured in a locked position against the tab engaging portion of the stopper. In the locked position, the shackle is inserted through both the slot of the stopper and the opening of the tab, and the lock locked. After the lock is unlocked and the shackle withdrawn from the slot of the stopper and the opening of the tab, the locking pin may be displaced by rotating the locking pin so as to pivot the tab of the locking pin clear of the tab engaging portion of the stopper. When the tab of the locking pin is clear of the tab engaging portion of the stopper, the locking pin may be displaced outwardly from the locking pin receiving aperture.

Those of ordinary skill in the art will be aware of other variations that are within the scope of the claimed invention, which is to be measured by the following claims.

What is claimed is:

1. A door latching device for a container having a door with a locking stanchion on its outer side, said stanchion being rotatable about its axis between locked and unlocked positions, said latching device comprising:

a locking pin receiving aperture in said stanchion in transverse intersecting relation to its axis, a puck shaped shackleless lock having a locking bar and a key-receiving portion, a rigid housing having a back wall adapted for rigid connection to said outer side of said door, a sidewall structure rigidly secured to said back wall and extending outwardly therefrom to define a chamber having a front opening, a partition wall rigidly secured to said sidewall structure in spaced and parallel relation to said back wall dividing said chamber into an outer compartment in which said lock is disposed and an inner compartment, said partition wall having a centrally positioned pin guiding channel, a first opening in said sidewall structure outwardly of said partition wall adapted to receive said key-receiving portion of said puck shaped lock, and a second opening in said sidewall structure opposite the part thereof in which said first opening is formed in, said second opening being disposed in said inner compartment inwardly of said partition wall, and a locking pin axially shiftable between a locking position and an unlocking position having, a cylindrical pin portion disposed in said inner compartment and extending axially through said second opening at a right angle to said axis of said stanchion, and a tab rigidly secured to said cylindrical pin portion and extending radially away from said pin portion through said channel and into said outer compartment, said tab including an opening for receiving said locking bar of said puck shaped shackleless lock when said lock is placed in said outer compartment and said locking pin is in its locking position, said pin portion extending into said pin receiving aperture of said stanchion when said stanchion is in its locked position and said locking pin is in its locking position.

2. The door latching device of claim 1 wherein said pin portion and said second opening are cylindrical.

3. The door latching device of claim 2, having a bushing secured to said side wall structure in said inner compartment in axial alignment with said cylindrical second opening, said cylindrical pin portion extending through said bushing.

4. The door latching device of claim 1 having a shelf secured to and extending from the exterior of said sidewall structure in a manner preventing sawing of said locking pin.

* * * * *